US006538648B1

(12) United States Patent
Koike et al.

(10) Patent No.: US 6,538,648 B1
(45) Date of Patent: Mar. 25, 2003

(54) DISPLAY DEVICE

(75) Inventors: Atsushi Koike, Neyagawa (JP); Yasuo Onishi, Kyoto (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/299,731

(22) Filed: Apr. 27, 1999

(30) Foreign Application Priority Data

Apr. 28, 1998 (JP) ..... 10-119640
Apr. 28, 1998 (JP) ..... 10-119641

(51) Int. Cl.[7] ..... G09G 5/00; G09G 3/36
(52) U.S. Cl. ..... 345/213; 348/520
(58) Field of Search ..... 345/99, 212, 213, 345/132; 348/563, 540, 539, 524, 537, 555, 526

(56) References Cited

U.S. PATENT DOCUMENTS 5,309,235 A * 5/1994 Naimpally ..... 348/476
5,406,308 A * 4/1995 Shiki ..... 345/127
5,786,866 A * 7/1998 Sani et al. ..... 348/520
5,841,430 A * 11/1998 Kurikko ..... 345/213
5,896,525 A * 4/1999 Nakatani ..... 395/560
5,900,854 A * 5/1999 Itoh et al. ..... 345/99
5,912,713 A * 6/1999 Tsunoda et al. ..... 348/540
5,940,136 A * 8/1999 Abe et al. ..... 348/537
5,963,183 A * 10/1999 Takahashi ..... 345/213
5,978,041 A * 11/1999 Masuda et al. ..... 348/563
6,011,534 A * 1/2000 Tanaka et al. ..... 345/98
6,043,803 A * 3/2000 Shimizu ..... 345/132
6,115,020 A * 9/2000 Taguchi et al. ..... 345/99
6,144,355 A * 11/2000 Murata et al. ..... 345/99

FOREIGN PATENT DOCUMENTS

DE 196 08 692 A 9/1996
EP 0 519 744 A 12/1992
EP 0 622 775 A 11/1994
EP 0 807 923 A 11/1997
JP 7-20824 1/1995
JP 9-297555 11/1997
JP 10-91127 4/1998

OTHER PUBLICATIONS

"Automatic Mode Adjustment" IBM Technical Disclosure Bulletin, vol. 37, No. 5, May 1, 1994, p. 469/470.
"Automatic Horizontal Centering Adjustment" IBM Technical Disclosure Bulletin, vol. 37, No. 5, May 1, 1994, p. 551/552.
Copy of Japanese Patent Application Notice for corresponding Japanese Patent Application 10–119641 dated Jul. 16, 2001.
Copy of Japanese Patent application Notice for corresponding Japanese Patent Application 10–119640 dated Mar. 19,1999.

* cited by examiner

*Primary Examiner*—Richard Hjerpe
*Assistant Examiner*—Kevin M. Nguyen
(74) *Attorney, Agent, or Firm*—Armstrong, Westerman & Hattori, LLP

(57) ABSTRACT

A display device including a clock generation circuit for generating sampling clocks, whose frequency is variable, on the basis of a horizontal synchronizing signal of an input image signal; an analog-to-digital converter for sampling the input image signal on the basis of the sampling clocks generated from the clock generation circuit; calculation device for calculating the number of sampling clocks outputted from a horizontal image start position to a horizontal image end position in image data outputted from the analog-to-digital converter, comparison device for comparing the number of sampling clocks calculated by the calculation means with a previously set value, and a controller for controlling the frequency of the sampling clocks outputted from the clock generation circuit on the basis of the results of the comparison in the comparison means.

9 Claims, 6 Drawing Sheets

DISPLAY DEVICE

BACKGROUND OF THE INVENTION

1. Field of the Invention

The present invention relates generally to a display device, and particularly, to a liquid crystal display device capable of suitably displaying an image irrespective of the total number of dots in a horizontal period of an input image signal.

2. Description of the Prior Art

In a liquid crystal display device, one of dots represented by dot data of an input image signal and one of pixels composing a liquid crystal panel are synchronized with each other in one horizontal scanning period, to display an image. Line data representing one horizontal scan line out of an arbitrary number of line data in one vertical scanning period of the input image signal is displayed in correspondence with one line in the vertical direction of the liquid crystal panel. The line data is a set of dot data.

In recent years, computers with a large variety of specifications have been fabricated. An image signal shown in FIG. 6 and an image signal shown in FIG. 7 differ in the total number of dots in a horizontal period (hereinafter referred to as the total of horizontal dots), for example, even if they are XGA (Extended Graphic Array) image signals outputted from various types of computers. In the XGA image signals, the respective total numbers of dots within an image effective period in the horizontal period (hereinafter referred to as the number of horizontal effective dots) are common. That is, the number of horizontal effective dots of the XGA image signal is 1024. The position where the image effective period starts shall be referred to as a horizontal image start position, and the position where the image effective period ends shall be referred to as a horizontal image end position.

Sampling clocks for sampling 1024 dots within the image effective period in the horizontal period of the inputted XGA image signal are generated on the basis of a horizontal synchronizing signal of the inputted XGA image signal. Consequently, a method of generating the sampling clocks must be changed depending on the total number of horizontal dots of the inputted XGA image signal. Therefore, it is necessary to recognize the total number of horizontal dots of the inputted XGA image signal in order to generate the sampling clocks.

Conventionally, a table storing the total number of horizontal dots has been prepared for each type of XGA image signals, where the type of the XGA image signal is judged from the characteristics of the XGA image signal inputted from the computer, and the total number of horizontal dots corresponding to the judged type is selected from the table, thereby recognizing the total number of horizontal dots of the inputted XGA image signal. However, this method cannot cope with the XGA image signal generated by a computer with a new specification.

SUMMARY OF THE INVENTION

An object of the present invention is to provide a display device capable of generating suitable sampling clocks with respect to a plurality of types of image signals whose respective numbers of horizontal effective dots have been known and whose respective totals of horizontal dots differ from each other and which is, therefore, capable of displaying a suitable image with respect to a plurality of types of image signals whose respective numbers of horizontal effective dots have been known and whose respective totals of horizontal dots differ from each other.

A first display device according to the present invention comprises a clock generation circuit for generating sampling clocks, whose frequency is variable, on the basis of a horizontal synchronizing signal of an input image signal; an analog-to-digital converter for sampling the input image signal on the basis of the sampling clocks generated from the clock generation circuit; calculation means for calculating the number of sampling clocks outputted from a horizontal image start position to a horizontal image end position in image data outputted from the analog-to-digital converter, comparison means for comparing the number of sampling clocks calculated by the calculation means with a previously set value; and control means for controlling the frequency of the sampling clocks outputted from the clock generation circuit on the basis of the results of the comparison in the comparison means.

An example of the clock generation circuit is one comprising a voltage control oscillator for outputting the sampling clocks, a frequency divider for dividing the frequency of the sampling clocks outputted from the voltage control oscillator, phase detection means, to which an output signal from the frequency divider and the horizontal synchronizing signal of the input image signal are inputted, for outputting a detection signal corresponding to the phase difference between both the inputted signals, and filter means for integrating the detection signal outputted from the phase detection means, to output the integrated detection signal to the voltage control oscillator. In this case, the frequency division ratio of the frequency divider is controlled by the control means.

An example of the calculation means is one comprising a detection circuit for respectively detecting the position where the horizontal image starts and the position where the horizontal image ends on the basis of the data outputted from the analog-to-digital converter, a counter for calculating the number of first sampling clocks outputted from the clock generation circuit from the timing at which the horizontal synchronizing signal of the input image signal is outputted to the position, where the horizontal image starts, detected by the detection circuit and the number of second sampling clocks outputted from the clock generation circuit from the timing at which the horizontal synchronizing signal of the input image signal is outputted to the position, where the horizontal image ends, detected by the detection circuit, and a subtractor for subtracting the number of first sampling clocks from the number of second sampling clocks.

An example of the comparison means is one for comparing the number of sampling clocks calculated by the calculation means with the number of horizontal effective dots of the input image signal previously set and a number larger by one than the number of horizontal effective dots, to output a first judgment signal depending on whether the number of sampling clocks calculated by the calculation means coincides with either the number of horizontal effective dots of the input image signal or the number larger by one than the number of horizontal effective dots or coincides with neither of them, and output a second judgment signal dependent on whether the number of sampling clocks calculated by the calculation means is smaller than the number of horizontal effective dots of the input image signal or the number larger by one than the number of horizontal effective dots.

An example of the control means is an up-down counter respectively receiving a vertical synchronizing signal of the input image signal as a clock, the first judgment signal from the comparison means as an enable signal, and the second judgment signal from the comparison means as an up-down control signal, and having a predetermined default value preset therein.

The up-down counter inhibits a clock counting operation when the first judgment signal indicates that the number of sampling clocks calculated by the calculation means coincides with either the number of horizontal effective dots of the input image signal or the number larger by one than the number of horizontal effective dots, while performing an up-counting operation every time the vertical synchronizing signal is inputted when the second judgment signal indicates that the number of sampling clocks calculated by the calculation means is smaller than the number of horizontal effective dots of the input image signal, and performing a down-counting operation every time the vertical synchronizing signal is inputted when the second judgment signal indicates that the number of sampling clocks calculated by the calculation means is larger than the number which is larger by one than the number of horizontal effective dots of the input image signal. The frequency of the sampling clocks outputted from the clock generation circuit is controlled on the basis of a count value of the up-down counter.

A second display device according to the present invention is characterized by comprising a clock generation circuit for generating sampling clocks, whose frequency is variable, on the basis of a horizontal synchronizing signal of an input image signal; an analog-to-digital converter for sampling the input image signal on the basis of the sampling clocks generated from the clock generation circuit; detection means for comparing image data outputted from the analog-to-digital converter with a predetermined threshold value, to detect a horizontal image start position and a horizontal image end position for each horizontal period; calculation means for calculating, on the basis of a horizontal image start position nearest to the position, where the horizontal period starts, specified by the horizontal synchronizing signal out of horizontal image start positions detected for each field and a horizontal image end position farthest from the position, where the horizontal period starts, specified by the horizontal synchronizing signal out of horizontal image end positions detected for each field, the number of sampling clocks corresponding to the distance from the horizontal image start position and the horizontal image end position of the input image signal for the field; comparison means for comparing the number of sampling clocks calculated by the calculation means with a previously set value; and control means for controlling the frequency of the sampling clocks outputted from the clock generation circuit on the basis of the results of the comparison in the comparison means.

An example the clock generation circuit is one comprising a voltage control oscillator for outputting the sampling clocks, a frequency divider for dividing the frequency of the sampling clocks outputted from the voltage control oscillator, phase detection means, to which an output signal from the frequency divider and the horizontal synchronizing signal of the input image signal are inputted, for outputting a detection signal corresponding to the phase difference between both the inputted signals, and filter means for integrating the detection signal outputted from the phase detection means, to output the integrated detection signal to the voltage control oscillator. In this case, the frequency division ratio of the frequency divider is controlled by the control means.

An example of the comparison means is one for comparing the number of sampling clocks calculated by the calculation means with the number of horizontal effective dots, previously set, of the input image signal and a number larger by one than the number of horizontal effective dots, to output a first judgment signal dependent on whether the number of sampling clocks calculated by the calculation means coincides with either the number of horizontal effective dots of the input image signal or the number larger by one than the number of horizontal effective dots, and a second judgment signal dependent on whether the number of sampling clocks calculated by the calculation means is smaller than the number of horizontal effective dots of the input image signal or the number larger by one than the number of horizontal effective dots.

An example of the control means is an up-down counter respectively receiving a vertical synchronizing signal of the input image signal as a clock, the first judgment signal from the comparison means as an enable signal, and the second judgment signal from the comparison means as an up-down control signal, and having a predetermined default value preset therein.

The up-down counter inhibits a clock counting operation when the first judgment signal indicates that the number of sampling clocks calculated by the calculation means coincides with either the number of horizontal effective dots of the input image signal or the number larger by one than the number of horizontal effective dots, while performing an up-counting operation every time the vertical synchronizing signal is inputted when the second judgment signal indicates that the number of sampling clocks calculated by the calculation means is smaller than the number of horizontal effective dots of the input image signal, and performing a down-counting operation every time the vertical synchronizing signal is inputted when the number of sampling clocks calculated by the calculation means is larger than the number which is larger by one than the number of horizontal effective dots of the input image signal. The frequency of the sampling clocks outputted from the clock generation circuit is controlled on the basis of a count value of the up-down counter.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
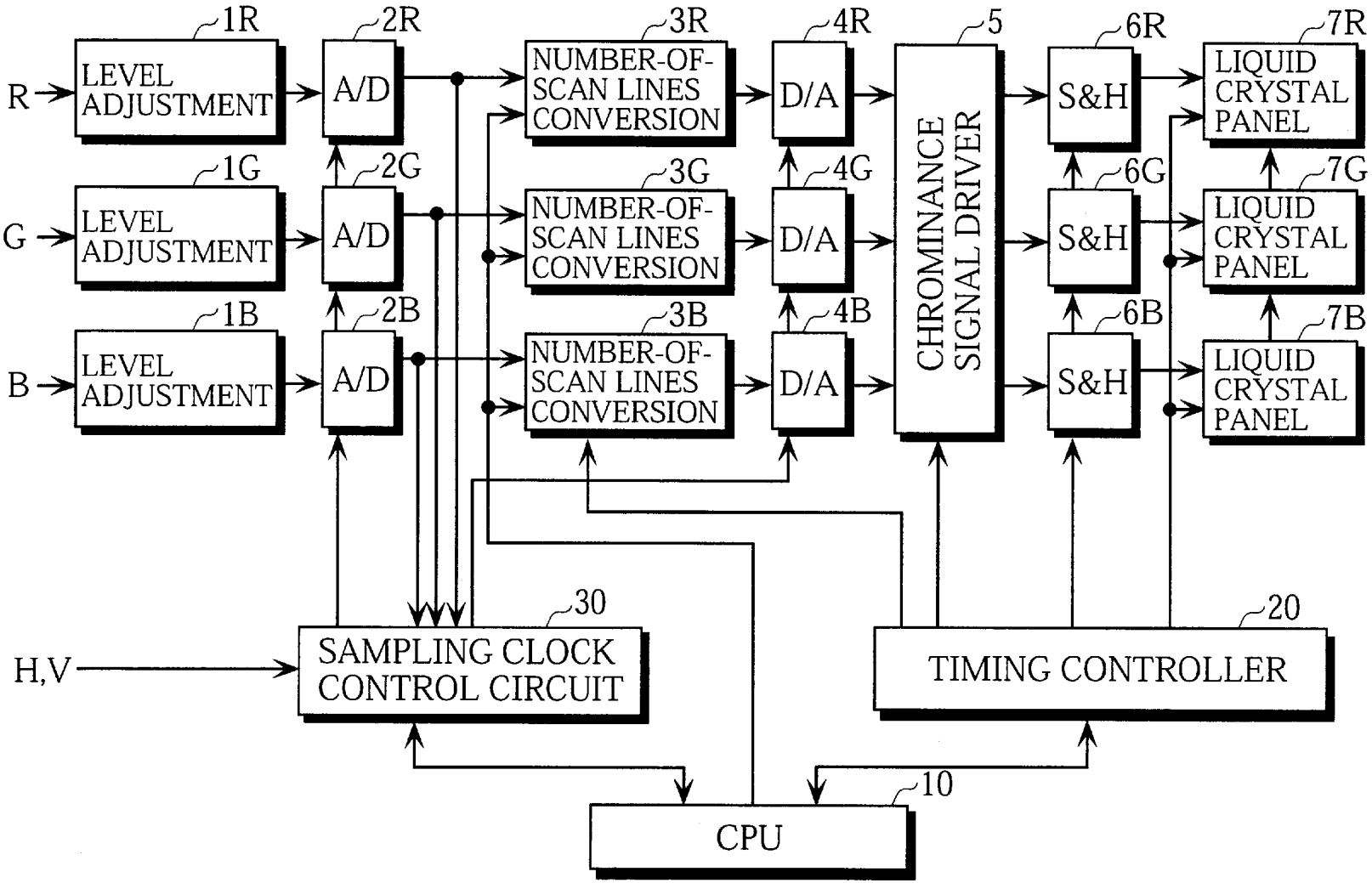
FIG. 1 is a block diagram showing the overall configuration of a liquid crystal display device.

Referring now to the drawings, description is made of embodiments in a case where the present invention is applied to a liquid crystal display device.

[1] Description of the First Embodiment

FIG. 1 illustrates the overall configuration of a liquid crystal display device.

The levels of XGA image signals R, G, and B fed from a computer are respectively adjusted so as to conform to the input conditions of analog-to-digital (A/D) converters 2R, 2G, and 2B in the succeeding stage by level adjustment units 1R, 1G, and 1B. The image signals R, G, and B whose levels have been adjusted are respectively converted into digital image data R, G, and B by the A/D converters 2R, 2G, and 2B, and the digital image signals R, G, and B are respectively fed to number-of-scan lines conversion circuits 3R, 3G, and 3B.

In the number-of-scan lines conversion circuits 3R, 3G, and 3B, the respective scan lines of the image signals R, G, and B are converted so as to be adaptable to liquid crystal panels 7R, 7G, and 7B. Outputs of the number-of-scan lines conversion circuits 3R, 3G, and 3B are respectively converted into analog image signals R, G, and B by digital-to-analog (D/A) converters 4R, 4G, and 4B.

The image signals R, G, and B outputted from the D/A converters 4R, 4G, and 4B are respectively fed to the liquid crystal panels 7R, 7G, and 7B through a chrominance signal driver 5 and sample-and-hold circuits 6R, 6G, and 6B.

A timing signal is fed from a timing controller 20 to the number-of-scan lines conversion circuits 3R, 3G, and 3B, the chrominance signal driver 5, the sample-and-hold circuits 6R, 6G, and 6B, and the liquid crystal panels 7R, 7G, and 7B. Sampling clocks sent to the A/D converters 2R, 2G, and 2B and the D/A converters 4R, 4G, and 4B are generated by a sampling clock control circuit 30. The timing controller 20 and the sampling clock control circuit 30 are controlled by a CPU 10.

Figure 6:
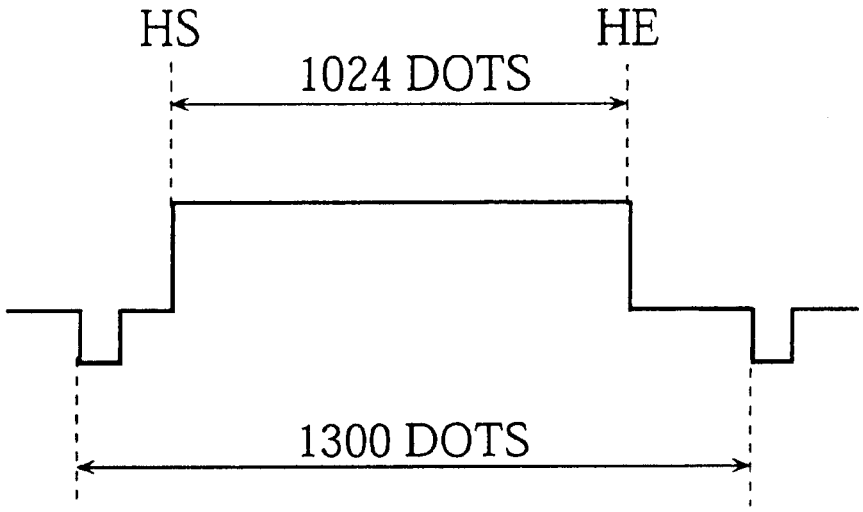
FIG. 6 PRIOR ART
FIG. 6 is a timing chart showing an XGA image signal.
Figure 7:
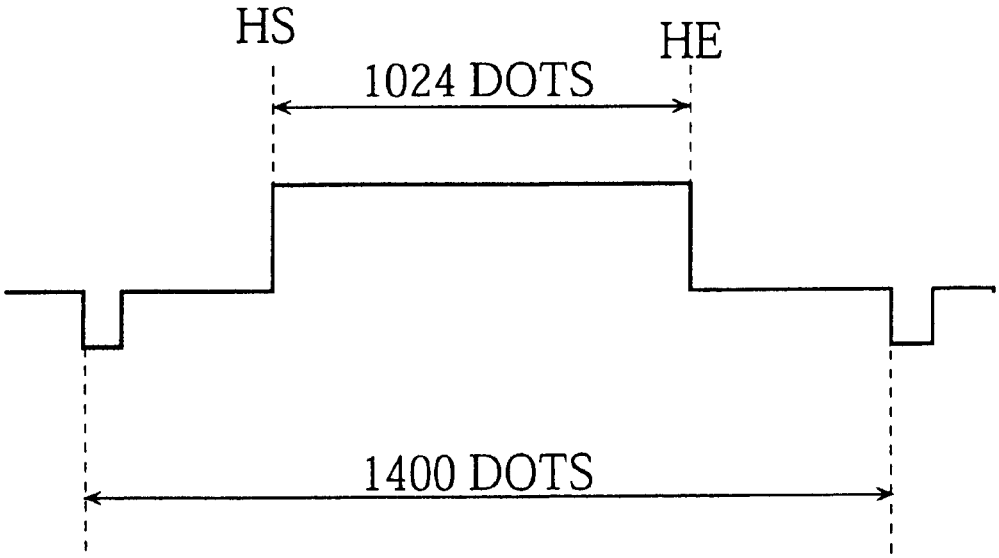
FIG. 7 PRIOR ART
FIG. 7 is a timing chart showing another XGA image signal which differs in the total of horizontal dots from the XGA image signal shown in FIG. 6.

Two types of XGA image signals shown in FIGS. 6 and 7 are taken as examples, to describe the principle of the operating of the sampling clock control circuit 30.

The difference between a value obtained by counting sampling clocks from the position where a horizontal synchronizing signal is outputted to a horizontal image start position HS (hereinafter referred to as a horizontal image start count value) and a value obtained by counting sampling clocks from the position where the horizontal synchronizing signal is outputted to a horizontal image end position HE (hereinafter referred to as a horizontal image end count value) is measured.

When the difference between the horizontal image start count value and the horizontal image end count value is larger than 024 it is considered that the frequency of the sampling clocks is higher than a suitable frequency, to carry out such control so as to decrease the frequency of the sampling clocks.

Contrary to this, when the difference between the horizontal image start count value and the horizontal image end count value is smaller than "1024", it is considered that the frequency of the sampling clocks is lower than the suitable frequency, to carry out such control as to increase the frequency of the sampling clocks.

Figure 3:
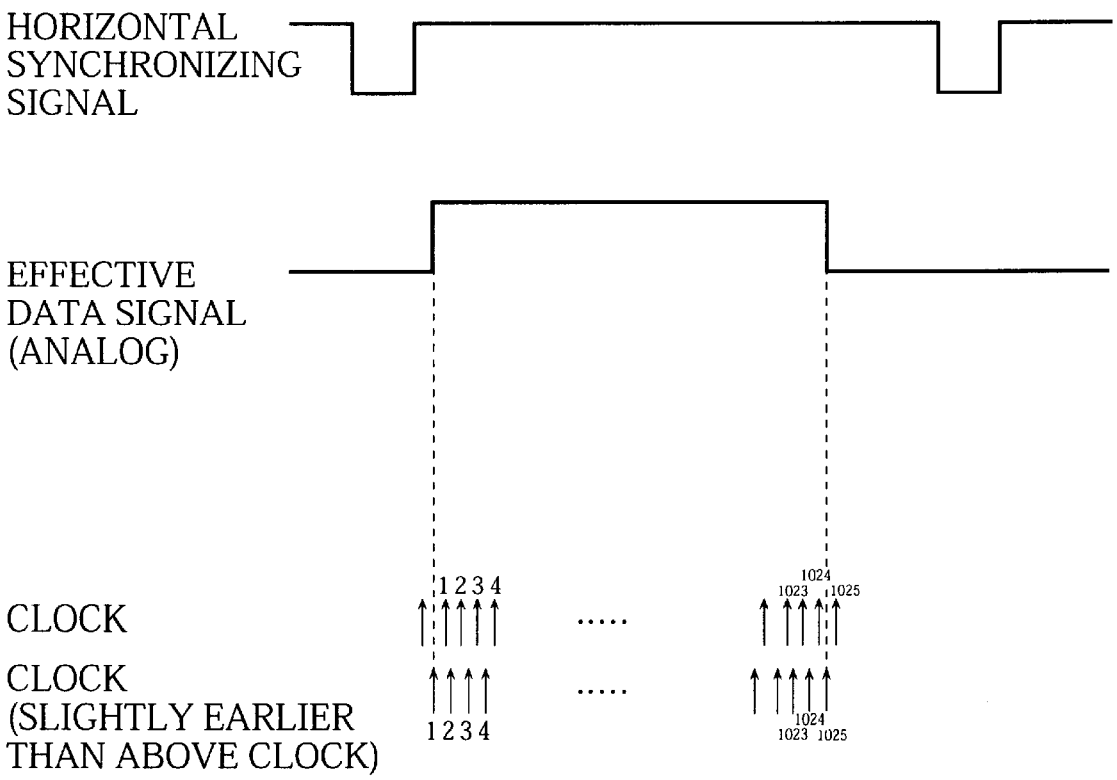
FIG. 3 is a timing chart showing that the difference between a horizontal image start count value and a horizontal image end count value may be "1024" or "1025" depending on the phase of sampling clocks using a horizontal synchronizing signal as a basis even if the frequency of the sampling clocks is suitable.

The waveform of the analog image signal before sampling (A/D conversion) is dull, for example, the difference between the horizontal image start count value and the horizontal image end count value is liable to be slightly larger than an actual number of dots "1024". Therefore, it is considered that even if the frequency of the sampling clocks is suitable, the difference between the horizontal image start count value and the horizontal image end count value may be "1024" or "1025" depending on the phase of the sampling clocks using the horizontal synchronizing signal as a basis, as shown in FIG. 3.

In the present invention, it is considered that the frequency of the sampling clocks is suitable when the difference between the horizontal image start count value and the horizontal image end count value is "1024" or "1025". In a case where the difference between the horizontal image start count value and the horizontal image end count value is "1025" when the phase of the sampling clocks is changed, however, the difference between the horizontal image start count value and the horizontal image end count value may be "1026". Therefore, fine adjustment is made such that the difference between the horizontal image start count value and the horizontal image end count value is "1024" or "1025", irrespective of the phase of the sampling clocks. The fine adjustment is made by delaying the phase of the sampling clocks by a value corresponding to at least one sampling clock in several nano units after the difference between the horizontal image start count value and the horizontal image end count value is "1024" or "1025".

Figure 2:
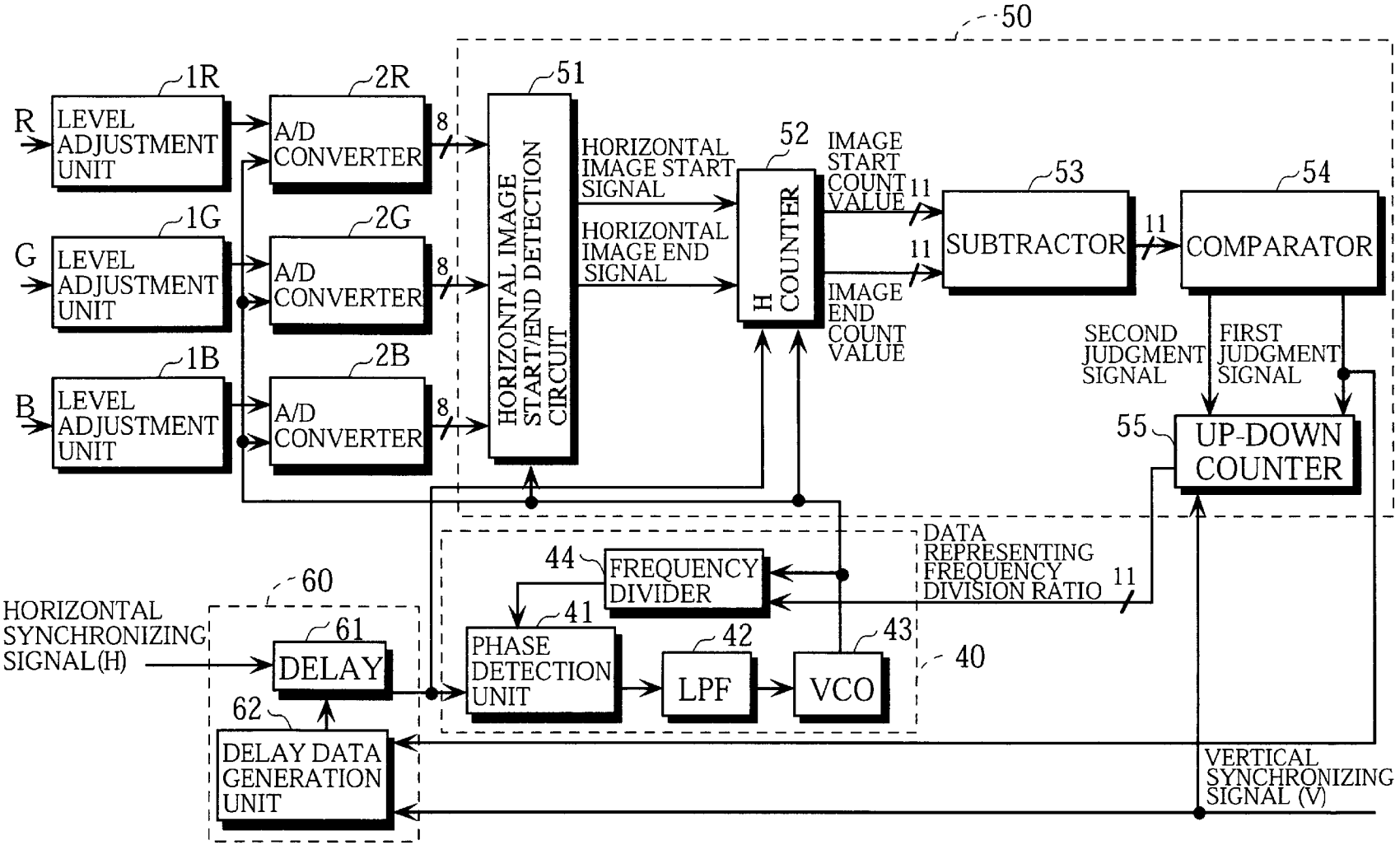
FIG. 2 is a block diagram showing the configuration of a sampling clock control circuit according to a first embodiment.

FIG. 2 illustrates the configuration of a sampling clock control circuit 30.

The sampling cock control circuit 30 detects the total of horizontal dots of such an XGA image signal that the entire screen is white (an image signal having a high luminance) fed from a personal computer on the basis of a test signal composed of the XGA image signal, to control the frequency of sampling clocks.

The sampling clock control circuit 30 detects the total of horizontal dots of such an XGA image signal that the entire screen is white (an image signal having a high luminance) fed from a personal computer on the basis of a test signal composed of the XGA image signal, to control the frequency of sampling clocks.

The phase control circuit 60 comprises a delay circuit 61 to which a horizontal synchronizing signal of an input image signal is inputted and a delay data generation unit 62 for controlling the delay circuit 61.

The PLL circuit 40 comprises a phase detection unit 41, an LPF (Low Pass Filter) 42, a VCO (Voltage Control Oscillator) 43, and a frequency divider 44, as is well known. The horizontal synchronizing signal fed through the delay circuit 61 and an output of the frequency divider 44 are inputted to the phase detection unit 41. An output of the phase detection unit 41 is inputted to the LPF 42. An output of the LPF 42 is inputted to the VCO 43. Sampling clocks outputted from the VCO 43 and data representing a frequency division ratio from the total-of-horizontal dots detection circuit 50 (the total-of-horizontal dots detection data) are inputted to the frequency divider 44.

The total-of-horizontal dots detection circuit 50 comprises a horizontal image start/end detection circuit 51, an H counter 52, a subtractor 53, a comparator 54, and an up-down counter 55.

The horizontal image start/end detection circuit 51 detects a horizontal image start position HS (see FIGS. 6 and 7) and a horizontal image end position HE (see FIGS. 6 and 7) on the basis of the data outputted from the A/D converters 2R, 2G, and 2B. Specifically, the horizontal image start/end detection circuit 51 outputs a horizontal image start signal composed of a pulse signal corresponding to one sampling clock when the inputted image data R, G and B are larger than a predetermined threshold value. The horizontal image start/end detection circuit 51 outputs a horizontal image end signal composed of a pulse signal corresponding to one sampling clock when the inputted image data R, G, and B are smaller than the predetermined threshold value.

When a large value is set as the threshold value, data having a low luminance cannot be read. When a small value is set as the threshold value, noises may be read as data. Therefore, such a small value as to be slightly larger than the value of the noises is set as the threshold value.

The horizontal image start signal and the horizontal image end signal from the horizontal image start/end detection circuit 51 are fed to the H counter 52. The H counter 52 takes the timing at which the horizontal synchronizing signal outputted from the delay circuit 61 is outputted as a reference time point, to count sampling clocks outputted from the reference time point to the time when the horizontal image start signal is outputted, and sends a value obtained by the counting (hereinafter referred to as a horizontal image start count value) to the subtractor 53. The H counter 52 counts sampling clocks outputted from the reference time point to the time when the horizontal image end signal is outputted, and sends a value obtained by the counting (hereinafter referred to as a horizontal image end count value) to the subtractor 53.

The subtractor 53 subtracts the horizontal image start count value from the horizontal image end count value. The results of the subtraction are sent to the comparator 54. The comparator 54 judges whether the number of horizontal effective dots of the XGA image signal coincides with "1024" or "1025" which is larger by one than "1024", is smaller than "1024", or is larger than "1025".

The comparator 54 brings a first judgment signal into an L level when the results of the subtraction coincide with either "1024" or "1025", while bringing the first judgment signal into an H level when the results of the subtraction coincide with neither "1024" nor "1025".

The comparator 54 brings a second judgment signal into an L level when the results of the subtraction are larger than "1025", while bringing the second judgment signal into an H level when the results of the subtraction are smaller than "1024".

The first judgment signal is inputted to an enable signal input terminal of the up-down counter 55. The second judgment signal is inputted to an up-down input terminal of the up-down counter 55. Further, a vertical synchronizing signal of the input image signal is inputted to a clock input terminal of the up-down counter 55.

The up-down counter 55 does not perform a counting operation even if the vertical synchronizing signal is inputted to the clock input terminal when the first judgment signal is at an L level (the results of the subtraction coincide with "1024" or "1025".

The up-down counter 55 performs a down-counting operation every time the vertical synchronizing signal is inputted to the clock input terminal when the first judgment signal is at an H level and the second judgment signal is at an L level (the results of the subtraction are larger than "1025".

The up-down counter 55 performs an up-counting operation every time the vertical synchronizing signal is inputted to the clock input terminal when the first judgment signal is at an H level and the second judgment signal is at an H level (the results of the subtraction are smaller than "1024").

A count value of the up-down counter 55 is inputted to the frequency divider 44 as data representing a frequency division ratio (total-of-horizontal dots detection data). A default value of the data representing a frequency division ratio is set in the up-down counter 55 at the time of initialization. A value close to a general total of horizontal dots of the XGA image signal is set as the default value.

When the vertical synchronizing signal is inputted to the up-down counter 55 in a case where the second judgment signal is at an L level (the results of the subtraction in the subtractor 53 are larger than "1025"), the count value of the up-down counter 55 decreases by one, so that the frequency division ratio of the frequency divider 44 also decreases by one. As a result, the frequency of the sampling clocks outputted from the VCO 43 decreases.

Contrary to this, when the vertical synchronizing signal is inputted to the up-down counter 55 in a case where the second judgment signal is at an H level (the results of the subtraction in the subtractor 53 are smaller than "1024"), the count value of the up-down counter 55 increases by one, so that the frequency division ratio of the frequency divider 44 also increases by one. As a result, the frequency of the sampling clocks outputted from the VCO 43 increases.

When the results of the subtraction in the subtractor 53 coincide with "1024" or "1025", the first judgment signal is brought into an L level, so that the count value of the up-down counter 55 does not change. The first judgment signal is also fed to the delay data generation unit 62. The delay data generation unit 62 controls the delay circuit 61 so as to delay the horizontal synchronizing signal in several nano units every time the vertical synchronizing signal is inputted in order to make fine adjustment, as described later, when the first judgment signal enters an L level.

When the total of delay values becomes a predetermined value which is not less than a value corresponding to one sampling clock, the delay data generation unit 62 stops delay control, and sends an instruction to terminate detection of the total of dots (hereinafter referred to as a total dot detection termination instruction) to the up-down counter 55. The up-down counter 55 forcedly brings, when the total dot detection termination instruction is inputted, an enable signal into an L level at that time point, not to change the count value.

The reason why the delay control is thus carried out after the results of the subtraction in the subtractor 53 coincides with "1024" or "1025" is as follows. The waveform of the analog image signal before sampling (A/D conversion) is dull, for example, as described above, so that the difference between the horizontal image start count value and the horizontal image end count value is liable to be slightly larger than an actual number of dots "1024".

Therefore, it is considered that even if the frequency of the sampling clocks is correct, the difference between the horizontal image start count value and the horizontal image end count value may be "1024" or "1025" depending on the phase of the sampling clocks using the horizontal synchronizing signal as a basis, as shown in FIG. 3.

Therefore, it is considered that the frequency of the sampling clocks is suitable when the difference between the horizontal image start count value and the horizontal image end count value is "1024" or "1025". When the phase of the sampling clocks is changed in a case where the difference between the horizontal image start count value and the horizontal image end count value is judged to be "1025", however, the difference between the horizontal image start count value and the horizontal image end count value may be "1026".

After the difference between the horizontal image start count value and the horizontal image end count value is judged to be "1024" or "1025", the phase of the sampling clocks is changed in a predetermined range. When the difference between the horizontal image start count value and the horizontal image end count value is "1026", fine adjustment is made such that the frequency of the sampling clocks decreases.

[2] Second Embodiment

Also in the second embodiment, the entire configuration of a liquid crystal display device is the same as that shown in FIG. 1. In the second embodiment, a sampling clock control circuit differs from that in the first embodiment.

In FIGS. 6 and 7, a horizontal image start position HS and a horizontal image end position HE of an XGA image signal are detected on the basis of the level of the image signal. Although in the first embodiment, the horizontal image start position HS and the horizontal image end position HE can be accurately detected when effective data exist in all dots within an image effective period in a horizontal period, therefore, the horizontal image start position HS and the horizontal image end position HE cannot be accurately detected when no effective data exist in all the dots within the image effective period.

In the second embodiment, a horizontal image start position and a horizontal image end position are detected for each horizontal period within one vertical period, a horizontal image start position nearest to the position, where the horizontal period starts, specified by a horizontal synchronizing signal out of horizontal image start positions detected in one field is determined as the final horizontal image start position, and a horizontal image end position farthest from the position, where the horizontal period starts, specified by the horizontal synchronizing signal out of horizontal image end positions detected in one field is determined as the final horizontal image end position.

Figure 4:
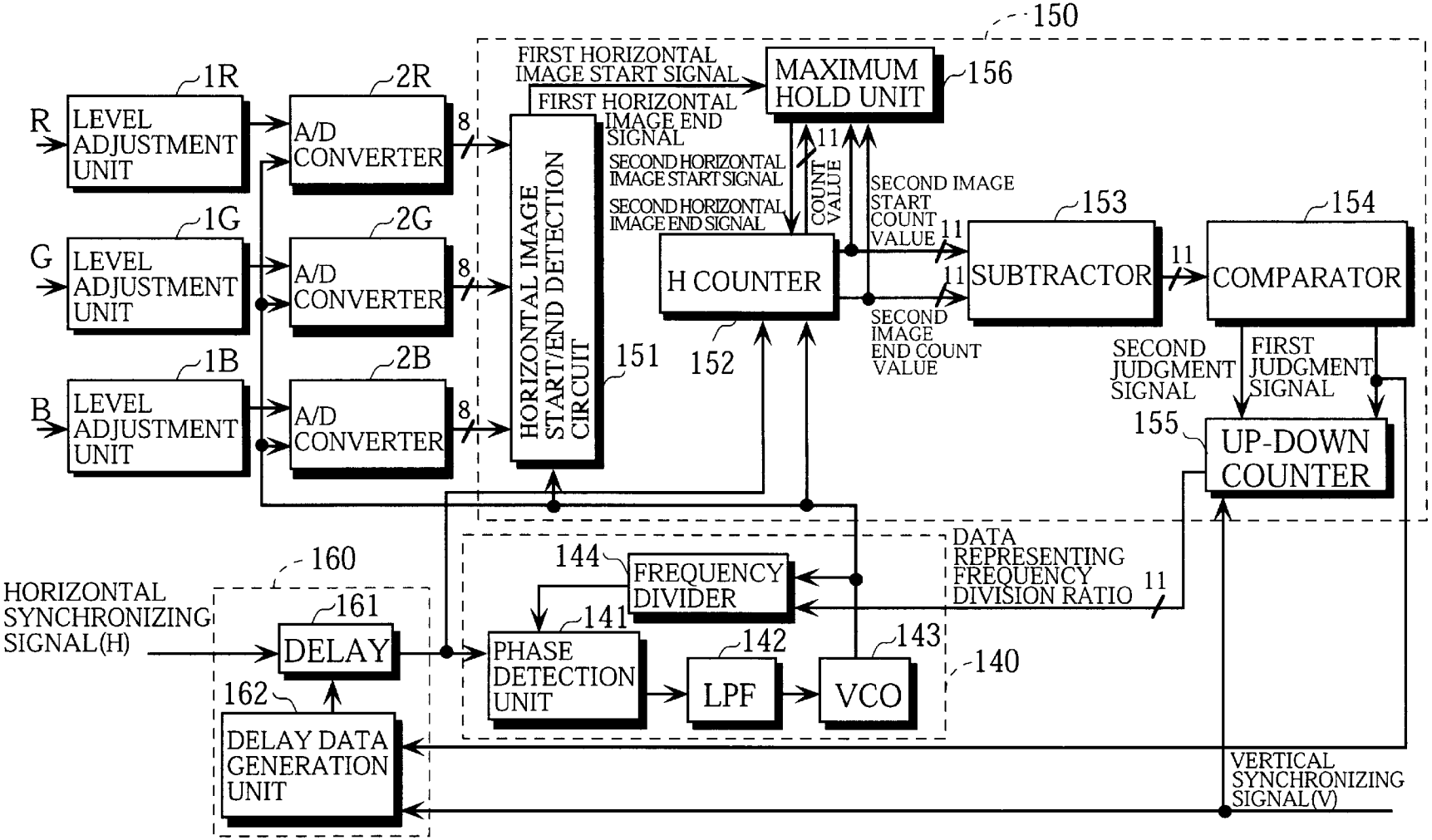
FIG. 4 is a block diagram showing the configuration of a sampling clock control circuit according to a second embodiment.

FIG. 4 illustrates the configuration of a sampling clock control circuit 30 in the second embodiment.

The sampling cock control circuit 30 detects the total of horizontal dots of such an XGA image signal that the entire screen is white (an image signal having a high luminance) fed from a personal computer on the basis of a test signal composed of the XGA image signal, to control the frequency of sampling clocks.

The sampling clock control circuit 30 is constituted by a PLL circuit 140 for outputting sampling clocks on the basis of a horizontal synchronizing signal of an input image signal, a total-of-horizontal dots detection circuit 150 for controlling the frequency of the sampling clocks outputted from the PLL circuit 140, and a phase control circuit 160 for controlling the phase of the sampling clocks outputted from the PLL circuit 140.

The phase control circuit 160 comprises a delay circuit 161 to which a horizontal synchronizing signal of an input image signal is inputted and a delay data generation unit 162 for controlling the delay circuit 161.

The PLL circuit 140 comprises a phase detection unit 141, an LPF 142, a VCO 143, and a frequency divider 144, as is well known. The horizontal synchronizing signal fed through the delay circuit 161 and an output of the frequency divider 144 are inputted to the phase detection unit 141. An output of the phase detection unit 141 is inputted to the LPF 142. An output of the LPF 142 is inputted to the VCO 143. Sampling cloaks outputted from the VCO 143 and data representing a frequency division ratio from the total-of-horizontal dots detection circuit 150 (total-of-horizontal dots detection data) are inputted to the frequency divider 144.

The total-of-horizontal dots detection circuit 150 comprises a horizontal image start/end detection circuit 151, an H counter 152, a subtractor 153, a comparator 154, an up-down counter 155 , and a maximum hold unit 156.

The horizontal image start/end detection circuit 151 detects a horizontal image start position HS (see FIGS. 6 and 7) and a horizontal image end position HE (see FIGS. 6 and 7) for each horizontal period on the basis of data outputted from A/D converters 2R, 2G, and 2B, and outputs a first horizontal image start signal and a first horizontal image end signal.

Specifically, the horizontal image start/end detection circuit 151 outputs a first horizontal image start signal composed of a pulse signal corresponding to one sampling clock when inputted image data R, G, and B are larger than a predetermined threshold value. The horizontal image start/end detection circuit 151 outputs a first horizontal image end signal composed of a pulse signal corresponding to one sampling clock when the inputted image data R, G, and B are smaller than the predetermined threshold value.

When a large value is set as the threshold value, data having a low luminance cannot be read. When a small value is set as the threshold value, noises may be read as data. Therefore, such a small value as to be slightly larger than the value of the noises is set as the threshold value.

The H counter 152 counts sampling clocks inputted to the H counter 152. The H counter 152 is reset every time the horizontal synchronizing signal of the input image signal is inputted through the delay circuit 161. Consequently, the H counter 152 counts sampling clocks outputted from the timing at which the horizontal synchronizing signal outputted from the delay circuit 161 is outputted for each horizontal period. A count value of the H counter 152 is sent to the maximum hold unit 156.

The H counter 152 holds, when a second horizontal image start signal is fed from the maximum hold unit 156, a count value at that time as a second image start count value, and outputs the count value. The H counter 152 holds, when a second horizontal image end signal is fed from the maximum hold unit 156, a count value at that time as a second image end count value, and outputs the count value.

The second image start count value and the second image end count value which are outputted from the H counter 152 are sent to the subtractor 153, and are also sent to the maximum hold unit 156. An initial value of the second image start count value is set to a value slightly larger than a general value (600, for example) , and an initial value of the second image end count value is set to a value slightly smaller than a general value (700, for example).

The first horizontal image start signal and the first horizontal image end signal from the horizontal image start/end detection circuit 151 are fed to the maximum hold unit 156. The maximum hold unit 156 performs the following operations.

Every time the first horizontal image start signal is inputted from the horizontal image start/end detection circuit 151, the maximum hold unit 156 reads a count value of the H counter 152 (hereinafter referred to as a first image start count value) Only when the first image start count value currently read is smaller than the second image start count value sent from the H counter 152, the second horizontal image start signal is outputted to the H counter 152. The H counter 152 holds, when the second horizontal image start signal is inputted, a count value at that time as a second image start count value, and outputs the count value to the maximum hold unit 156 and the subtractor 153.

Every time the first horizontal image end signal is inputted from the horizontal image start/end detection circuit 151, the maximum hold unit 156 reads a count value of the H counter 152 (hereinafter referred to as a first image end count value) . Only when the first image end count value currently read is larger than the second image end count value sent from the H counter 152, the second horizontal image end signal is outputted to the H counter 152. The H counter 152 holds, when the second horizontal image end signal is inputted, a count value at that time as a second image end count value, and outputs the count value to the maximum hold unit 156 and the subtractor 153.

The subtractor 153 subtracts the second image start count value from the second image end count value. The results of the subtraction are sent to the comparator 154. The comparator 154 judges whether the results of the subtraction sent from the subtractor 153 coincide with the number of horizontal effective dots "1024" of the XGA image signal or "1025" which is larger by one than "1024", is smaller than "1024", or is larger than "1025".

The comparator 154 brings a first judgment signal into an L level when the results of the subtraction coincide with either "1024" or "1025", while bringing the first judgment signal into an H level when the results of the subtraction coincide with neither "1024" nor "1025".

The comparator 154 brings a second judgment signal into an L level when the results of the subtraction are larger than "1025", while bringing the second judgment signal into an H level when the results of the subtraction are smaller than "1024".

The first judgment signal is inputted to an enable signal input terminal of the up-down counter 155. The second judgment signal is inputted to an up-down input terminal of the up-down counter 155. Further, a vertical synchronizing signal of the input image signal is inputted to a clock input terminal of the up-down counter 155.

The up-down counter 155 does not perform a counting operation even if the vertical synchronizing signal is inputted to a clock input terminal when the first judgment signal is at an L level (the results of the subtraction coincide with "1024" or "1025").

The up-down counter 155 performs a down-counting operation every time the vertical synchronizing signal is inputted to the clock input terminal when the first judgment signal is at an H level and the second judgment signal is at an L level (the results of the subtraction are larger than "1025").

The up-down counter 155 performs an up-counting operation every time the vertical synchronizing signal is inputted to the clock input terminal when the first judgment signal is at an H level and the second judgment signal is at an H level (the results of the subtraction are smaller than "1024").

A count value of the up-down counter 155 is inputted to the frequency divider 144 as data representing a frequency division ratio (total-of-horizontal dots detection data). A default value of the data representing a frequency division ratio is set in the up-down counter 155 at the time of initialization. A value close to a general total of horizontal dots of the XGA image signal is set as the default value.

When the vertical synchronizing signal is inputted to the up-down counter 155 in a case where the second judgment signal is at an L level (the results of the subtraction in the subtractor 153 are larger than "1025") , the count value of the up-down counter 155 decreases by one, so that the frequency division ratio of the frequency divider 144 also decreases by one. As a result, the frequency of the sampling clocks outputted from the VCO 143 decreases.

Contrary to this, when the vertical synchronizing signal is inputted to the up-down counter 155 in a case where the second judgment signal is at an H level (the results of the subtraction in the subtractor 153 are smaller than "1024"), the count value of the up-down counter 155 increases by one, so that the frequency division ratio of the frequency divider 144 also increases by one. As a result, the frequency of the sampling clocks outputted from the VCO 143 increases.

When the results of the subtraction in the subtractor 153 coincide with "1024" or "1025", the first judgment signal is brought into an L level, so that the count value of the up-down counter 155 does not change. The first judgment signal is also fed to the delay data generation unit 162. The delay data generation unit 162 controls the delay circuit 161 so as to delay the horizontal synchronizing signal in several nano units every time the vertical synchronizing signal is inputted in order to make fine adjustment, as described in the first embodiment, when the first judgment signal enters an L level.

When the total of delay values becomes a predetermined value which is not less than a value corresponding to one sampling clock, the delay data generation unit 162 stops delay control, and sends a total dot detection termination instruction to the up-down counter 155. The up-down counter 155 forcedly brings, when the total dot detection termination instruction is inputted, an enable signal into an L level at that time point, not to change the count value.

The features of the second embodiment is that in each field, it is possible to hold the minimum value of the horizontal image start count value detected for each horizontal period and to hold the maximum value of the horizontal image end count value detected for each horizontal period.

Even if a horizontal period during which there is no effective image data exists in one field, therefore, the number of sampling clocks corresponding to an image effective period in the horizontal period can be detected. That is, if at least one horizontal period during which effective data exists in a horizontal image start position and at least one horizontal period during which effective data exists in a horizontal image end position exist in one field, the number of sampling clocks corresponding to the image effective period can be detected.

Figure 5:
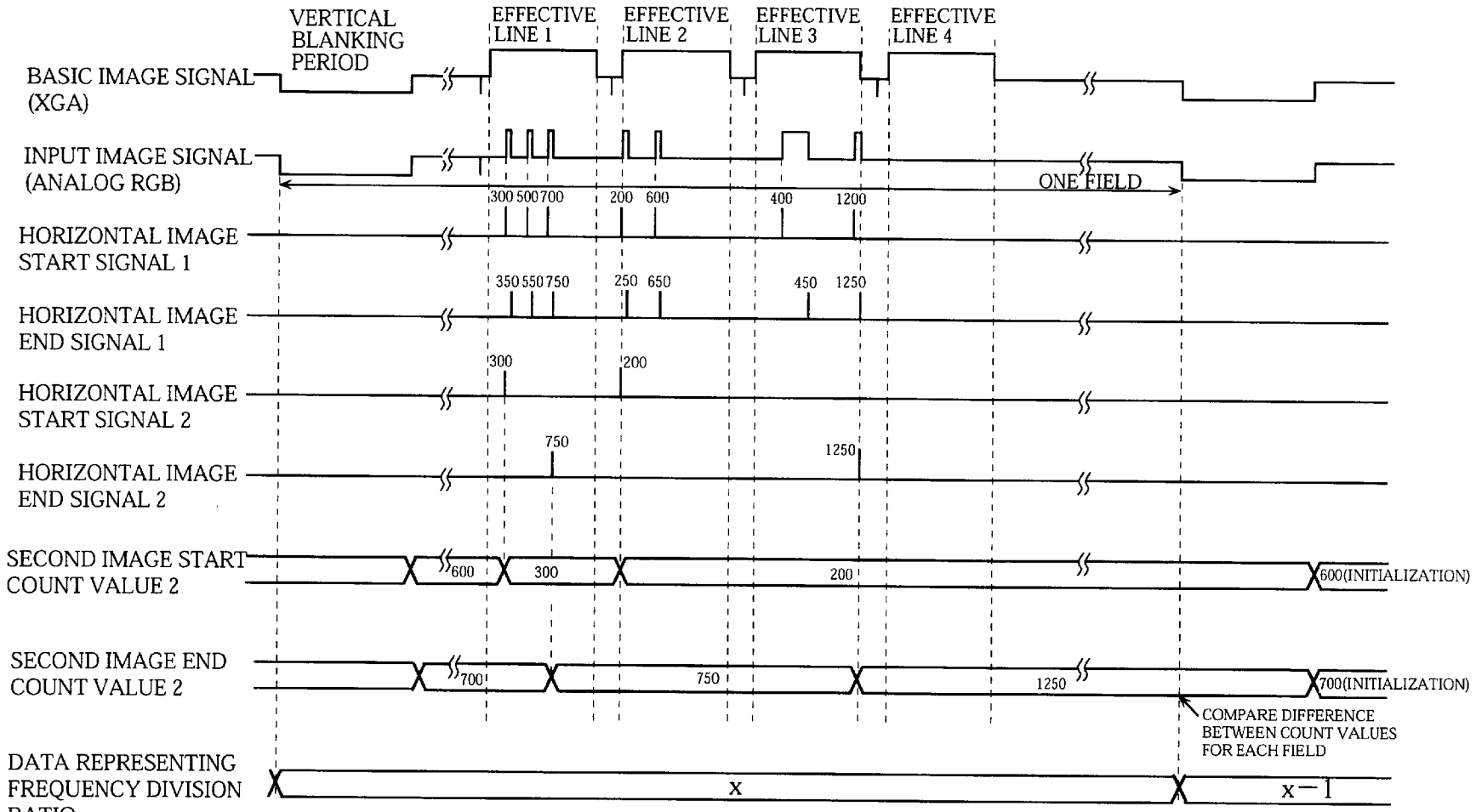
FIG. 5 is a timing chart showing the operation of a maximum hold unit.

Such features will be. described in more detail on the basis of FIG. 5.

It is assumed that effective data exist in the positions where the count value of the H counter 152 corresponds to "300" to "350", "500" to "550" and "700" to "750" in an effective line 1, effective data exist in the positions where the count value of the H counter 152 corresponds to "200" to "250" and "600" to "650" in an effective line 2, effective data exist in the positions where the count value of the H counter 152 correspond to "400" to "700" and "1200" to "1250" in an effective line 3, and no effective data exist in an effective line 4.

When a first horizontal image start signal corresponding to the count value "300" in the effective line 1 is inputted to the maximum hold unit 156, the current horizontal image start count value (a first image start count value) "300" is smaller than a second image start count value "600" held in the H counter 152, so that the maximum hold unit 156 outputs a second horizontal image start signal. Consequently, the second image start count value is updated from "600" to "300".

Thereafter, even if a first horizontal image start signal corresponding to the count value "500" or a first horizontal image start signal corresponding to the count value "700" is inputted to the maximum hold unit 156, the current horizontal image start count value "500" or "700" is larger than the horizontal image start count value "300" already held, so that the second horizontal image start signal is not outputted from the maximum hold unit 156. Consequently, the second image start count value is not updated.

When a first horizontal image start signal corresponding to the count value "1200" in the effective line 2 is inputted to the maximum hold unit 156, the current horizontal image start count value (a first image start count value) "200" is smaller than the second image start count value "300" held by the H counter 152, so that the maximum hold unit 156 outputs a second horizontal image start signal. Consequently, the second image start count value is updated from "300" to "200".

In the effective lines 3 and 4, a first horizontal image start signal corresponding to a count value smaller than the horizontal image start count value "200" is not outputted, so that a second horizontal image start signal is not outputted from the maximum hold unit 156. Consequently, the second image start count value is not updated.

When a first horizontal image end signal corresponding to the count value "750" in the effective line 1 is inputted to the maximum hold unit 156, the current horizontal image end count value (a first image end count value) "750" is larger than the second image end count value "700" held by the H counter 152, so that the maximum hold unit 156 outputs a second horizontal image end signal. Consequently, the second image end count value is updated from "700" to "750".

When a first horizontal image end signal corresponding to the count value "1250" in the effective line 3 is inputted to the maximum holding unit 156, the current horizontal image end count value (a first image end count value) "1250" is larger than a second image end count value "750" held by the H counter 152, so that the maximum hold unit 156 outputs a second horizontal image end signal. Consequently, the second image end count value is updated from "750" to "1250".

At the time point where the vertical synchronizing signal is inputted upon termination of the current field, a value "1050" obtained by subtracting the second image start count value "200" from the second image end count value "1250" is outputted from the subtractor 153. This value "1050" is larger than a value "1025" which is larger by one than the number of horizontal effective dots "1024" of the input image signal, so that a first judgment signal at an H level is outputted from the comparator 154, and a second judgment signal at an L level is outputted therefrom.

When the vertical synchronizing signal is inputted to the up-down counter 155, it is counted down, so that the count value of the up-down counter 155 is updated from a value "x" so far found to "(x−1)".

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display device comprising:

a clock generation circuit for generating sampling clocks, whose frequency is variable, on the basis of a horizontal synchronizing signal of an input image signal;

an analog-to-digital converter for sampling the input image signal on the basis of the sampling clocks generated from the clock generation circuit;

calculation means for calculating the number of sampling clocks outputted from a horizontal image start position to a horizontal image end position in image data outputted from the analog-to-digital converter;

comparison means for comparing the number of sampling clocks calculated by the calculation means with a previously set value; and control means for controlling the frequency of the sampling clocks outputted from the clock generation circuit on the basis of the results of the comparison in the comparison means, wherein the control means comprises an up-down counter respectively receiving a vertical synchronizing signal of the input image signal as a clock, the first judgment signal from the comparison means as an enable signal, and the second judgment signal from the comparison means as an up-down control signal, and having a predetermined default value preset therein.

2. The display device according to claim 1, wherein the clock generation circuit comprises:

a voltage control oscillator for outputting the sampling clocks;

a frequency divider for dividing the frequency of the sampling clocks outputted from the voltage control oscillator, phase detection means, to which an output signal from the frequency divider and the horizontal synchronizing signal of the input image signal are inputted, for outputting a detection signal corresponding to the phase difference between both the inputted signals, and filter means for integrating the detection signal outputted from the phase detection means, to output the integrated detection signal to the voltage control oscillator, the frequency division ratio of the frequency divider being controlled by the control means.

3. The display device according to claim 1, wherein the calculation means comprises a detection circuit for respectively detecting the position where the horizontal image starts and the position where the horizontal image ends on the basis of the data outputted from the analog-to-digital converter, a counter for calculating the number of first sampling clocks outputted from the clock generation circuit from the timing at which the horizontal synchronizing signal of the input image signal is outputted to the position, where the horizontal image starts, detected by the detection circuit and the number of second sampling clocks outputted from the clock generation circuit from the timing at which the horizontal synchronizing signal of the input image signal is outputted to the position, where the horizontal image ends, detected by the detection circuit, and a subtractor for subtracting the number of first sampling clocks from the number of second sampling clocks.

4. The display device according to claim 1, wherein the comparison means compares the number of sampling clocks calculated by the calculation means with the number of horizontal effective dots of the input image signal previously set and a number larger by one than the number of horizontal effective dots, to output a first judgment signal dependent on whether the number of sampling clocks calculated by the calculation means coincides with either the number of horizontal effective dots of the input image signal or the number larger by one than the number of horizontal effective dots or coincides with neither of them, and output a second judgment signal dependent on whether the number of sampling clocks calculated by the calculation means is smaller than the number of horizontal effective dots of the input image signal or the number larger by one than the number of horizontal effective dots.

5. The display device according to claim 4, wherein the up-down counter inhibits a clock counting operation when the first judgment signal indicates that the number of sampling clocks calculated by the calculation means coincides with either the number of horizontal effective dots of the input image signal or the number larger by one than the number of horizontal effective dots, while performing an up-counting operation every time the vertical synchronizing signal is inputted when the second judgment signal indicates that the number of sampling clocks calculated by the calculation means is smaller than the number of horizontal effective dots of the input image signal, and performs a down-counting operation every time the vertical synchronizing signal is inputted when the second judgment signal indicates that the number of sampling clocks calculated by the calculation means is larger than the number which is larger by one than the number of horizontal effective dots of the input image signal, the frequency of the sampling clocks outputted from the clock generation circuit being controlled on the basis of a count value of the up-down counter.

6. A display device comprising:

a clock generation circuit for generating sampling clocks, whose frequency is variable, on the basis of a horizontal synchronizing signal of an input image signal;

an analog-to-digital converter for sampling the input image signal on the basis of the sampling clocks generated from the clock generation circuit;

detection means for comparing image data outputted from the analog-to-digital converter with a predetermined threshold value, to detect a horizontal image start position and a horizontal image end position for each horizontal period;

calculation means for calculating, on the basis of a horizontal image start position nearest to the position, where the horizontal period starts, specified by the horizontal synchronizing signal out of horizontal image start positions detected for each field and a horizontal image end position farthest from the position, where the horizontal period starts, specified by the horizontal synchronizing signal out of horizontal image end positions detected for each field, the number of sampling clocks corresponding to the distance from the horizontal image start position and the horizontal image end position of the input image signal for the field;

comparison means for comparing the number of sampling clocks calculated by the calculation means with a previously set value; and control means for controlling the frequency of the sampling clocks outputted from the clock generation circuit on the basis of the results of the comparison in the comparison means, wherein the control means comprises an up-down counter respectively receiving a vertical synchronizing signal of the input image signal as a clock, the first judgment signal from the comparison means as an enable signal, and the second judgment signal from the comparison means as an up-down control signal, and having a predetermined default value preset therein.

7. The display device according to claim 6, wherein the clock generation circuit comprises a voltage control oscillator for outputting the sampling clocks, a frequency divider for dividing the frequency of the sampling clocks outputted from the voltage control oscillator, phase detection means, to which an output signal from the frequency divider and the horizontal synchronizing signal of the input image signal are inputted, for outputting a detection signal corresponding to the phase difference between both the inputted signals, and filter means for integrating the detection signal outputted from the phase detection means, to output the integrated detection signal to the voltage control oscillator, the frequency division ratio of the frequency divider being controlled by the control means.

8. The display device according to claim 6, wherein the comparison means compares the number of sampling clocks calculated by the calculation means with the number of horizontal effective dots, previously set, of the input image signal and a number larger by one than the number of horizontal effective dots, to output a first judgment signal dependent on whether the number of sampling clocks calculated by the calculation means coincides with either the number of horizontal effective dots of the input image signal or the number larger by one than the number of horizontal effective dots, and a second judgment signal dependent on whether the number of sampling clocks calculated by the calculation means is smaller than the number of horizontal effective dots of the input image signal or the number larger by one than the number of horizontal effective dots.

9. The display device according to claim 8, wherein the up-down counter inhibits a clock counting operation when the first judgment signal indicates that the number of sampling clocks calculated by the calculation means coincides with either the number of horizontal effective dots of the input image signal or the number larger by one than the number of horizontal effective dots, while performing an up-counting operation every time the vertical synchronizing signal is inputted when the second judgment signal indicates that the number of sampling clocks calculated by the calculation means is smaller than the number of horizontal effective dots of the input image signal, and performs a down-counting operation every time the vertical synchronizing signal is inputted when the number of sampling clocks calculated by the calculation means is larger than the number which is larger by one than the number of horizontal effective dots of the input image signal, the frequency of the sampling clocks outputted from the clock generation circuit being controlled on the basis of a count value of the up-down counter.

* * * * *